US011549341B2

(12) United States Patent
Al Naimi et al.

(10) Patent No.: US 11,549,341 B2
(45) Date of Patent: Jan. 10, 2023

(54) AGGREGATE MULTI-LATERAL MAXIMUM RESERVOIR CONTACT WELL AND SYSTEM FOR PRODUCING MULTIPLE RESERVOIRS THROUGH A SINGLE PRODUCTION STRING

(71) Applicant: Saudi Arabian Oil Company, Dhahran (SA)

(72) Inventors: Khalid M. Al Naimi, Alandulus (SA); Ali M Al Shahri, Dhahran (SA); Mohammed A. Al Mansouri, Dhahran (SA); Anas A. Al Shuaibi, Dhahran (SA); Mishaal S. Al Harbi, Khobar (SA); Mohammed S. Kanfar, Dammam (SA)

(73) Assignee: SAUDI ARABIAN OIL COMPANY

( * ) Notice: Subject to any disclaimer, the term of this patent is extended or adjusted under 35 U.S.C. 154(b) by 164 days.

(21) Appl. No.: 16/807,277

(22) Filed: Mar. 3, 2020

(65) Prior Publication Data

US 2021/0277747 A1 Sep. 9, 2021

(51) Int. Cl.

| | |
|---|---|
| ***E21B 41/00*** | (2006.01) |
| ***E21B 47/11*** | (2012.01) |
| ***E21B 43/14*** | (2006.01) |
| ***E21B 47/06*** | (2012.01) |

(Continued)

(52) U.S. Cl.

CPC ..... *E21B 41/0035* (2013.01); *E21B 43/14* (2013.01); *E21B 47/06* (2013.01); *E21B 47/11* (2020.05); *E21B 33/12* (2013.01); *E21B 34/06* (2013.01)

(58) Field of Classification Search

CPC ..... E21B 41/0035; E21B 43/26; E21B 43/14; E21B 43/305; E21B 23/12; E21B 29/06; E21B 7/046; E21B 7/04

See application file for complete search history.

(56) References Cited

U.S. PATENT DOCUMENTS

| | | | |
|---|---|---|---|
| 9,104,585 | B2 | 8/2015 | Dogru |
| 9,133,683 | B2 | 9/2015 | Dyer et al. |
| 9,754,833 | B2 | 8/2017 | Carvajal et al. |

(Continued)

OTHER PUBLICATIONS

Al-Umran, Mohammed I. et al.; "A Milestone for Smart MRC Wells in Saudi Arabia" SPE 115412, SPE Russian Oil & Gas Technical Conference & Exhibition, Oct. 28-30, 2008; pp. 1-7.

(Continued)

*Primary Examiner* — Zakiya W Bates

(74) *Attorney, Agent, or Firm* — Bracewell LLP; Constance Gall Rhebergen

(57) ABSTRACT

An aggregate MRC well includes a plurality of maximum reservoir contact (MRC) wells, a plurality of independently operated flow control or completion units installed in each of the plurality of MRC wells, a plurality of pressure regimes corresponding to the plurality of MRC wells, and a single production string connecting each of the plurality of MRC wells. The method includes providing a plurality of maximum reservoir contact (MRC) wells forming an aggregate MRC well, providing a plurality of independently operated flow control valves in each of the plurality of MRC wells, providing a plurality of pressure regimes corresponding to the plurality of MRC wells, and providing a single production string connecting each of the plurality of MRC wells.

10 Claims, 6 Drawing Sheets

(51) Int. Cl.
*E21B 33/12* (2006.01)
*E21B 34/06* (2006.01)

(56) References Cited

U.S. PATENT DOCUMENTS

| | | | | |
|---|---|---|---|---|
| 2005/0121190 | A1 | 6/2005 | Oberkircher et al. | |
| 2009/0008078 | A1 | 1/2009 | Patel | |
| 2009/0080291 | A1 | 3/2009 | Tubel et al. | |
| 2009/0308598 | A1* | 12/2009 | Gardes | E21B 43/006 166/246 |
| 2011/0011580 | A1 | 1/2011 | Clark et al. | |
| 2016/0061003 | A1 | 3/2016 | Gottumukkala et al. | |
| 2016/0130893 | A1 | 5/2016 | Pound et al. | |
| 2016/0312584 | A1 | 10/2016 | Hazel | |
| 2018/0030816 | A1 | 2/2018 | Devalve et al. | |
| 2018/0119533 | A1 | 5/2018 | Alhuthali et al. | |
| 2018/0347326 | A1 | 12/2018 | Shammari et al. | |
| 2018/0348389 | A1 | 12/2018 | Jaaskelainen et al. | |
| 2019/0120791 | A1 | 4/2019 | Al-Gouhi et al. | |
| 2021/0102446 | A1* | 4/2021 | Alghazali | E21B 34/08 |

OTHER PUBLICATIONS

Arukhe, J.O. et al.; "Smart Well Completion Optimization in Multilateral Wells" SPE-188732-MS, Abu Dhabi International Petroleum Exhibition & Conference, Nov. 13-16, 2017; pp. 1-10.

Kabir, M. et al.; "Application of a Maximum Reservoir Contact (MRC) Well in a Thin, Carbonate Reservoir in Kuwait" SPE 100834, SPE Annual Technical Conference & Exhibition, Sep. 24-27, 2006; pp. 1-8.

Mubarak, S.M. et al.; "Case Study: The Use of Downhole Control Valves To Sustain Oil Production From the First Maximum Reservoir Contact, Multilateral, and Smart Completion Well in Ghawar Field" SPE 120744, Nov. 2008 SPE Production & Op.; pp. 427-430.

Salamy, S.P. et al.; "Maximum-Reservoir-Contact-Wells Performance Update: Shaybah Field, Saudi Arabia" SPE 105141, Middle East Oil & Gas Show & Conference, Mar. 11-14, 2007; pp. 439-443.

Saleri, N.G. et al.; "SHAYBAH-220: A Maximum Reservoir Contact (MRC) Well and Its Implications for Developing Tight Facies Reservoirs" SPE 81487, 13th Middle East Oil Show & Conference, Apr. 5-8, 2003; pp. 1-7.

International Search Report and Written Opinion for International Applicaiton No. PCT/US2021/070224, report dated Jun. 14, 2021; pp. 1-12.

Qahtani, Abdullah M. et al.; "Future Advanced Completion Technologies to Maximize Recovery" OTC 20136, 2009 Offshore Technology Conference, Houston, TX, May 4-7, 2009; pp. 1-10.

* cited by examiner

AGGREGATE MULTI-LATERAL MAXIMUM RESERVOIR CONTACT WELL AND SYSTEM FOR PRODUCING MULTIPLE RESERVOIRS THROUGH A SINGLE PRODUCTION STRING

TECHNICAL FIELD

Embodiments generally relate to multilateral wells for extracting hydrocarbons from a subsurface formation. More specifically, embodiments relate to systems and methods for efficiently aggregating multiple reservoirs.

BACKGROUND

Hydrocarbon fluids such as oil and natural gas are obtained from a subterranean geologic formation or reservoir, by drilling a well that penetrates the hydrocarbon-bearing formation. Once a wellbore is drilled, various forms of well completion components may be installed to control and enhance the efficiency of producing various fluids from the reservoir.

In the recovery of hydrocarbons from the subterranean formations having hydrocarbon-bearing reservoirs, wellbores are drilled with multiple highly deviated or horizontal portions that extend through separate hydrocarbon-bearing production zones. Such "multilateral wells" include branches or laterals from a mother-bore that extend into the separate hydrocarbon-bearing production zones. Multilateral wells have increased in importance during the past decade and may be used for hydrocarbon production from "tight" reservoirs.

As result of the increasing use of multilateral wells, multilateral well modeling and performance prediction techniques have become increasingly important for a variety of purposes. Such techniques are used by production engineers to determine the wellhead pressures and inflow control valve (ICV) settings to achieve specific production flowrates. Multilateral well modeling and performance prediction may be particularly challenging due to the interplay between branches or laterals and pressure drop behaviors.

SUMMARY

Accordingly, one example embodiment of the present disclosure is an aggregate multi-lateral multi-reservoir maximum reservoir contact (MRC) well (henceforth called "aggregate MRC well") for extracting hydrocarbons from multiple subsurface formations. The aggregate MRC well includes a plurality of maximum reservoir contact (MRC) wells, a plurality of independently operated completion units installed in each of the plurality of MRC wells or laterals, a plurality of pressure regimes corresponding to the plurality of MRC wells or laterals, and a single production string connecting each of the plurality of MRC wells or laterals. The aggregate MRC well also includes a means for determining productivity index of each of the plurality of MRC wells or laterals. The means may include one or more pressure sensors installed at each of the plurality of MRC wells or laterals, and one or more chemical tracers installed at each of the plurality of MRC wells or laterals. The aggregate MRC well may also include a means for determining flow rate or production rate of each of the MRC wells or laterals. The means includes one or more flow rate sensors installed at each of the plurality of MRC wells or laterals. The aggregate MRC well may have a contact of about 10 kilometers (6.21 miles) or more. The aggregate MRC well may have a multilateral configuration including two or more lateral wells.

Another embodiment is a method for extracting hydrocarbons from a subsurface formation. The method includes providing a plurality of maximum reservoir contact (MRC) wells forming an aggregate MRC well, providing a plurality of independently operated completion units in each of the plurality of MRC wells or laterals, providing a plurality of pressure regimes corresponding to the plurality of MRC wells or laterals, and providing a single production string connecting each of the plurality of MRC wells or laterals. The method may further include providing a means for determining productivity index of each of the plurality of MRC wells or laterals. The means may include one or more pressure sensors installed at each of the plurality of MRC wells or laterals, and one or more chemical tracers installed at each of the plurality of MRC wells or laterals. The method may also include providing a means for determining flow rate or production rate of each of the MRC wells or laterals. The means may include one or more flow rate sensors installed at each of the plurality of MRC wells or laterals. The aggregate MRC well may have a contact of about 10 kilometers (6.21 miles) or more. The aggregate MRC well includes a multilateral configuration including two or more laterals.

In general, a flow control valve setting system and procedure are provided for use in a multizone well, e.g. a multilateral well, with zonal isolation provided by, for example, packers. A network of flow control valves is provided in a completion network disposed along isolated well zones of the lateral bore or bores of the multizone well. Data is acquired from individual downhole sensors (e.g. sensors for pressure, temperature, flow rates, positions, water/gas detection, and/or other parameters) corresponding with the flow control valves in the multizone well. The data may be processed on processor system modules/workflows which are used in selected combinations. Examples of such modules comprise completion network modules, deconvolution modules, optimization modules, and/or inflow-outflow modules. The modules are designed to process the collected data in a manner which facilitates adjustment of the optimum flow control valve settings in the network of flow control valves. The flow control valve settings are adjusted to improve a desired objective function, e.g. maximization of oil and/or minimization of water and gas production, of the multizone well while applying constraints at the multilateral/multizone level, e.g. constraints regarding draw down, bubble point, flow balance, and flow rate restriction.

BRIEF DESCRIPTION OF THE DRAWINGS

So that the manner in which the features, advantages and objects of the invention, as well as others which may become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only example embodiments of the invention and is therefore not to be considered limiting of its scope as the invention may admit to other equally effective embodiments.

DETAILED DESCRIPTION

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

Figure 1:
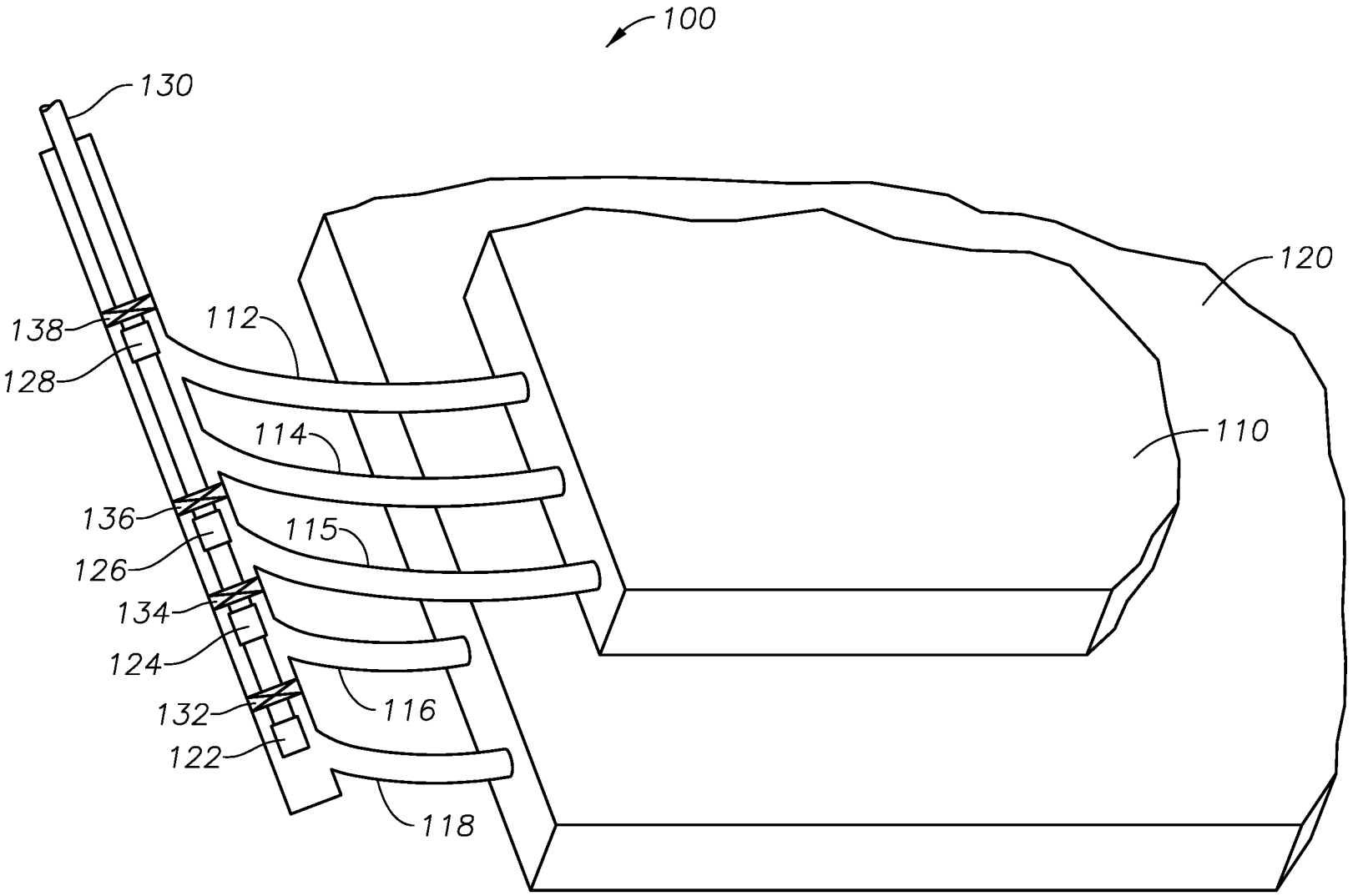
FIG. 1 illustrates an aggregate MRC well including multiple reservoirs with a multilateral configuration, according to one or more example embodiments.

FIG. 1 illustrates an aggregate MRC well 100 including multiple MRC wells 112, 114, 115, 116, 118 in a multilateral configuration, according to one or more example embodiments. FIG. 1 shows a schematic of an aggregate-MRC well 100 having a multilateral configuration including two separated reservoirs 110, 120, each including a plurality of maximum reservoir contact (MRC) wells 112, 114, 115, and 116 and 118, respectively. The aggregate MRC well also includes a plurality of independently operated flow control or completion units 122, 124, 126, and 128 installed in each of the plurality of MRC wells 112, 114, 115, 116, 118. The aggregate MRC well 100 is designed such that it provides a plurality of pressure regimes corresponding to the plurality of MRC wells or laterals 112, 114, 115, 116, 118. The aggregate MRC well also includes a plurality of annular isolators or packers 132, 134, 136, 138 installed in each of the plurality of MRC wells or laterals 112, 114, 115, 116, 118. However, there is a single production string 130 connecting each of the plurality of MRC wells or laterals 112, 114, 115, 116, 118. The aggregate MRC well 100 may have a contact of about 10 kilometers (6.21 miles) or more. The well 100 is shown equipped with pressure gauges, downhole control valves, packers separating the targeted zones in addition to the chemically distinguishable oil and water tracers, which will be described now in further detail with reference to FIG. 2.

Figure 2:
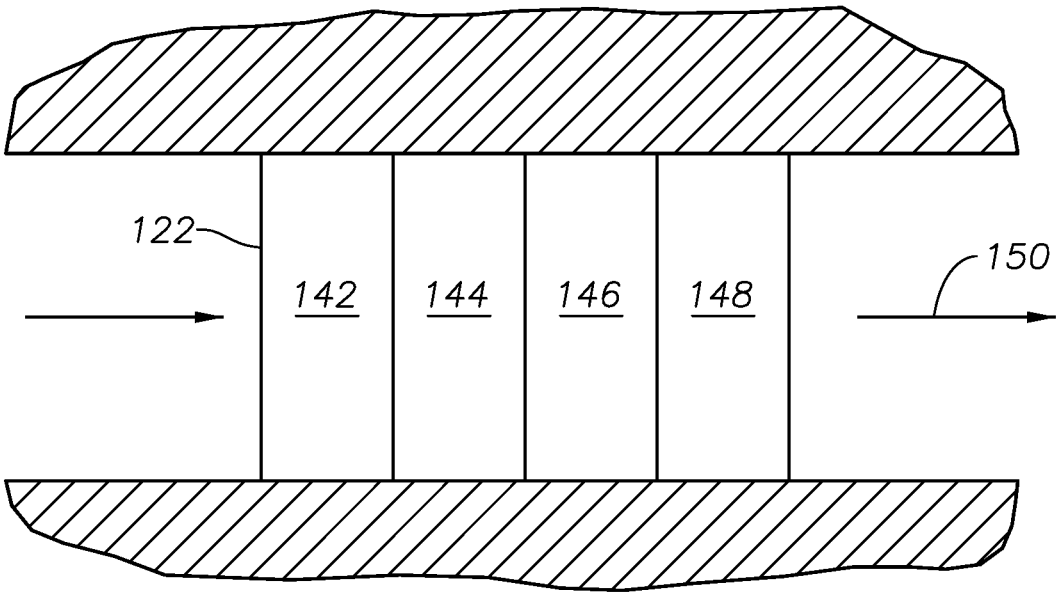
FIG. 2 illustrates a schematic of a control or completion unit installed at each lateral of the aggregate MRC well, according to an embodiment of the disclosure.

FIG. 2 illustrates a schematic of an example control or completion unit 122 installed at each of the laterals 112, 114, 115, 116, 118 in the aggregate MRC well 100, according to an embodiment of the disclosure. The control or completion unit 122 includes a means for determining productivity index of each of the plurality of MRC wells or laterals. The means may include one or more pressure sensors or pressure gauges 142 installed at each of the plurality of MRC wells or laterals 112, 114, 115, 116, 118. The means may also include one or more chemical tracers 144 installed at each of the plurality of MRC wells or laterals 112, 114, 115, 116, 118. The control or completion unit 122 may also include a means for determining flow rate or production rate of each of the MRC wells or laterals. This means may include one or more flow rate sensors 146 installed at each of the plurality of MRC wells or laterals 112, 114, 115, 116, 118. This means may also include one or more independently operable flow control valves 148 installed at each of the plurality of MRC wells or laterals 112, 114, 115, 116, 118. The flow control valves 148 can be configured to control flow of the hydrocarbon 150 coming out each of the plurality of MRC wells or laterals 112, 114, 115, 116, 118.

This embodiment allows to meet target rate for multiple stacked reservoirs from a single well while ensuring continuous monitoring of reservoir behavior and water breakthrough in the wells. The aggregate-MRC well combines multiple MRC wells that target different reservoirs into a single well. Production allocation from each reservoir can be tracked to provide and keep record for accurate history matching and modeling. The aggregate-MRC design addresses the allocation challenge by utilizing state-of-the-art technology to quantify and control production rates and pressures in each lateral.

Constant monitoring of pressure and rate of different laterals can create value in sweeping efficiency and optimizing production. This design includes multiple laterals targeting the desired reservoirs and equipped by dual ported pressure gauges 142 and downhole control valves 148 in addition to a chemically distinguished tracer 144 for each segment. The completion unit 122 provides a tool to conduct a comprehensive well testing by utilizing the different gauges 142 and valves 148 for individual laterals. This allows for several pressure transient analysis allowing for optimizing laterals spacing and placement in the future wells. Moreover, the dual-ported pressure gauge 142 accompanied by the downhole valves 148 opening positions provides a tool to estimate real-time downhole rate via the pressure difference and known liquid properties. The chemical tracers 144 provide a redundancy source of quantifying flow per lateral as well as identifying water breakthrough segments especially in the unlikely case of pressure gauges 142 failure. The water breakthrough can be estimated by a multiphase model by the downhole valves 148 opening positions and pressure gauges 142 along with surface rate measurement via the installed multi-phase flowmeter (MPFM) 146. This design ensures the longevity of the life of the well 100 by controlling high water producing zones and uniform rate contribution.

Another embodiment is a method for extracting hydrocarbons from a subsurface formation. The method includes providing a plurality of maximum reservoir contact (MRC) wells forming an aggregate MRC well, providing a plurality of independently operated flow control valves in each of the laterals, providing a plurality of pressure regimes corresponding to the plurality of laterals, and providing a single production string connecting each of the plurality of MRC wells or laterals. The method may further include providing a means for determining productivity index of each of the plurality of MRC wells or laterals. The means may include one or more pressure sensors installed at each of the plurality of MRC wells or laterals, and one or more chemical tracers installed at each of the plurality of MRC wells or laterals. The method may also include providing a means for determining flow rate or production rate of each of the MRC wells or laterals. The means may include one or more flow rate sensors installed at each of the plurality of MRC wells or laterals. The aggregate MRC well may have a contact of about 10 kilometers (6.21 miles) or more. The aggregate MRC well includes a multilateral configuration including two or more MRC laterals.

The terms "annular isolator" or "packer element" as used herein mean a material or mechanism or a combination of materials and mechanisms which block or prevent flow of fluids from one side of the isolator to the other in the annulus between a tubular member in a well and a borehole wall or casing. An annular isolator acts as a pressure bearing seal between two portions of the annulus. Since annular isolators must block flow in an annular space, they may have a ring like or tubular shape having an inner diameter in fluid tight contact with the outer surface of a tubular member and having an outer diameter in fluid tight contact with the inner wall of a borehole or casing. An annular isolator could be formed by tubing itself if it could be expanded into intimate contact with a borehole wall to eliminate the annulus. An isolator may extend for a substantial length along a borehole. In some cases, as described below, a conduit may be provided in the annulus passing through or bypassing an annular isolator to allow controlled flow of certain materials, e.g. hydraulic fluid, up or down hole.

Figure 3:
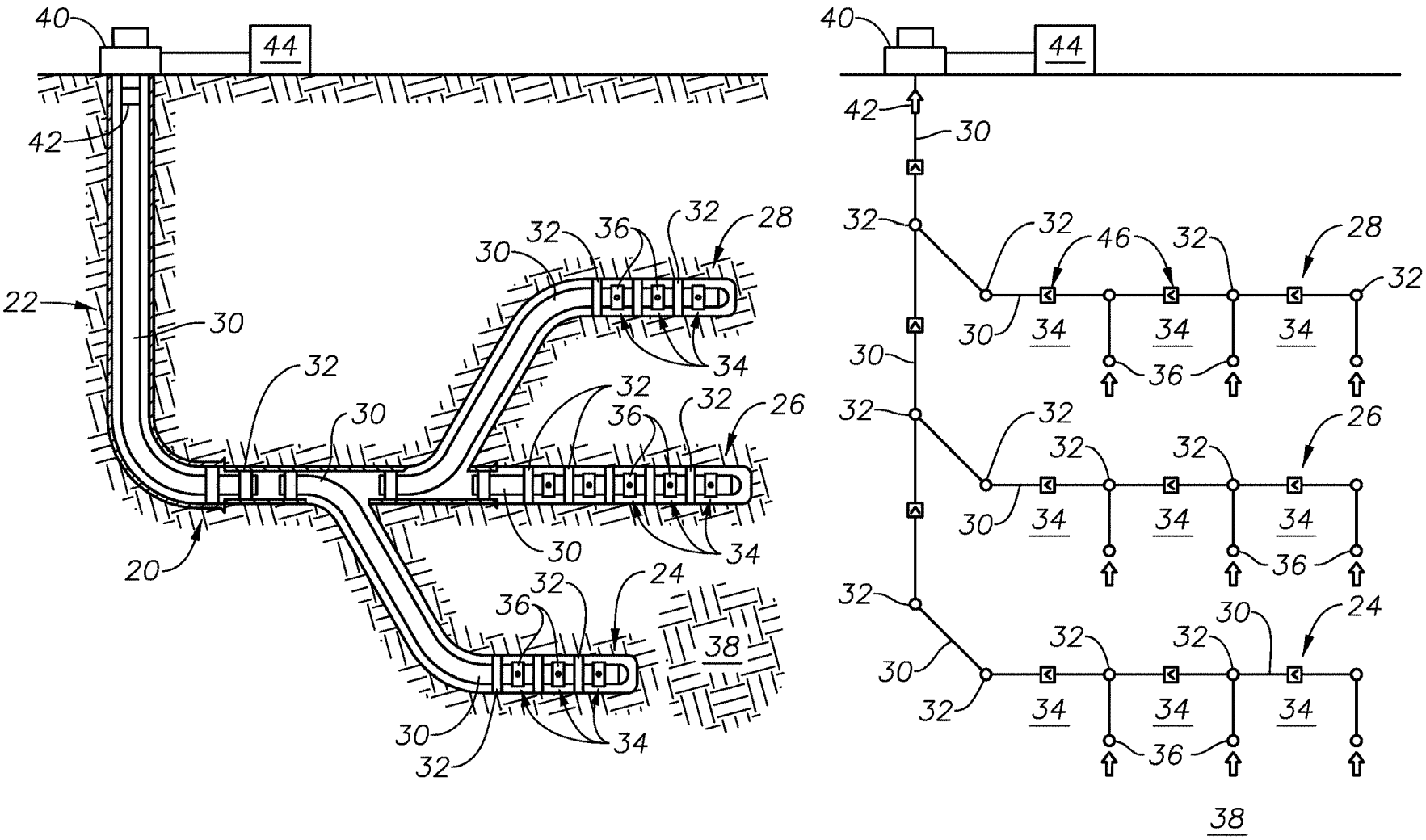
FIG. 3 is a schematic illustration of an example of a multizone well, e.g. a multilateral well, and completion juxtaposed with a completion network model, according to an embodiment of the disclosure.

FIG. 3 is a schematic illustration of an example of a multizone well, e.g. a multilateral well, and completion juxtaposed with a completion network model, according to an embodiment of the disclosure. Referring generally to FIG. 3, a simple network model representing a well completion 20, e.g. a multilateral well completion, disposed in a multizone well 22, e.g. a multilateral well having multiple isolated zones, may be constructed using suitable commercial software that can handle fluid flow calculations. In FIG. 3, the left side of the figure illustrates an example of an actual multilateral well completion 20 and multizone/multilateral well 22 while the right side of the figure illustrates the corresponding network model. It should be noted that the multizone well 22 may comprise a single lateral bore with multiple well zones or a plurality of lateral bores with multiple well zones. It should also be noted that although only three laterals are demonstrated, the aggregate MRC well may have a multilateral configuration including two or more laterals. Similar elements from the illustrated actual multilateral well completion and from the network model of the completion have been labeled with similar reference numerals.

In the example illustrated in FIG. 3, the multizone well 22 comprises a multilateral well having lateral bores 24, 26 and 28. However, the well may have other numbers and arrangements of lateral bores, and the illustrated embodiment is provided as an example to facilitate explanation of the flow control valve setting methodology. The well completion 20 comprises sections of tubing 30 which extend between and/or through various completion components, including packers 32 which isolate corresponding well zones 34. Additionally, the well completion 20 comprises a plurality of flow control valves 36 which control fluid flows and fluid flow rates from the various corresponding well zones 34 into multilateral well completion 20.

For example, well fluid may flow from a surrounding formation 38, e.g. a hydrocarbon fluids bearing formation, and into well completion 20 through flow control valves 36 at corresponding well zones 34. The fluid is commingled after flowing through the flow control valves 36 and the commingled fluid flow is directed up through tubing sections 30 to a wellhead 40 for collection. The wellhead 40 or other surface equipment also may comprise flow control equipment 42, e.g. a valve or other type of choking device, to control flow rates and pressures. As described in greater detail below, a control system 44 also may work in cooperation with a sensor system 46 to obtain and process data in a manner which facilitates improved setting of the flow control valves 36 so as to optimize, e.g. maximize, a desired objective function of the overall well completion 20.

The network model illustrated on the right side of FIG. 3 is constructed to represent the various components of multilateral well completion 20 including, for example, the inside and outside diameters of tubing sections 30, casing perforations in a cased well, depths of components, e.g. depths of flow control valves, number and position of lateral bores, well zones, reservoir properties, fluid parameters, and types of completion equipment, e.g. types of flow control valves. The network model, e.g. a nodal analysis software module such as Pipesim or a numerical model such as Eclipse or Petrel, may use existing data related to static wellbore parameters (e.g. inside diameters, outside diameters, and depths) diameters which normally do not change during the life of the well. Additionally, the model may utilize transient data which is regularly updated. The data may be updated episodically or in real time. Examples of the updated transient data include changes in pressures, fluid compositions (e.g. increasing GOR, water cut, and/or other fluid compositional changes) and changes in flow control valve positions, i.e. settings that are monitored via downhole sensors of sensor system 46. The downhole sensors may include sensors which are part of the flow control valves and sensors, e.g. pressure and temperature sensors, which are located separately in the various well zones and/or other well locations.

The network model utilizes workflows which perform data analysis and integrate accurate inputs of reservoir properties, pressures, fluid data, and/or other data to the model. The network model is then updated/calibrated for running optimization scenarios and for validating results for implementation of those optimization scenarios. Once flow control valve settings are implemented based on the validated optimization scenarios, the network model may be continually recalibrated which effectively continues the optimization loop.

Figure 4:
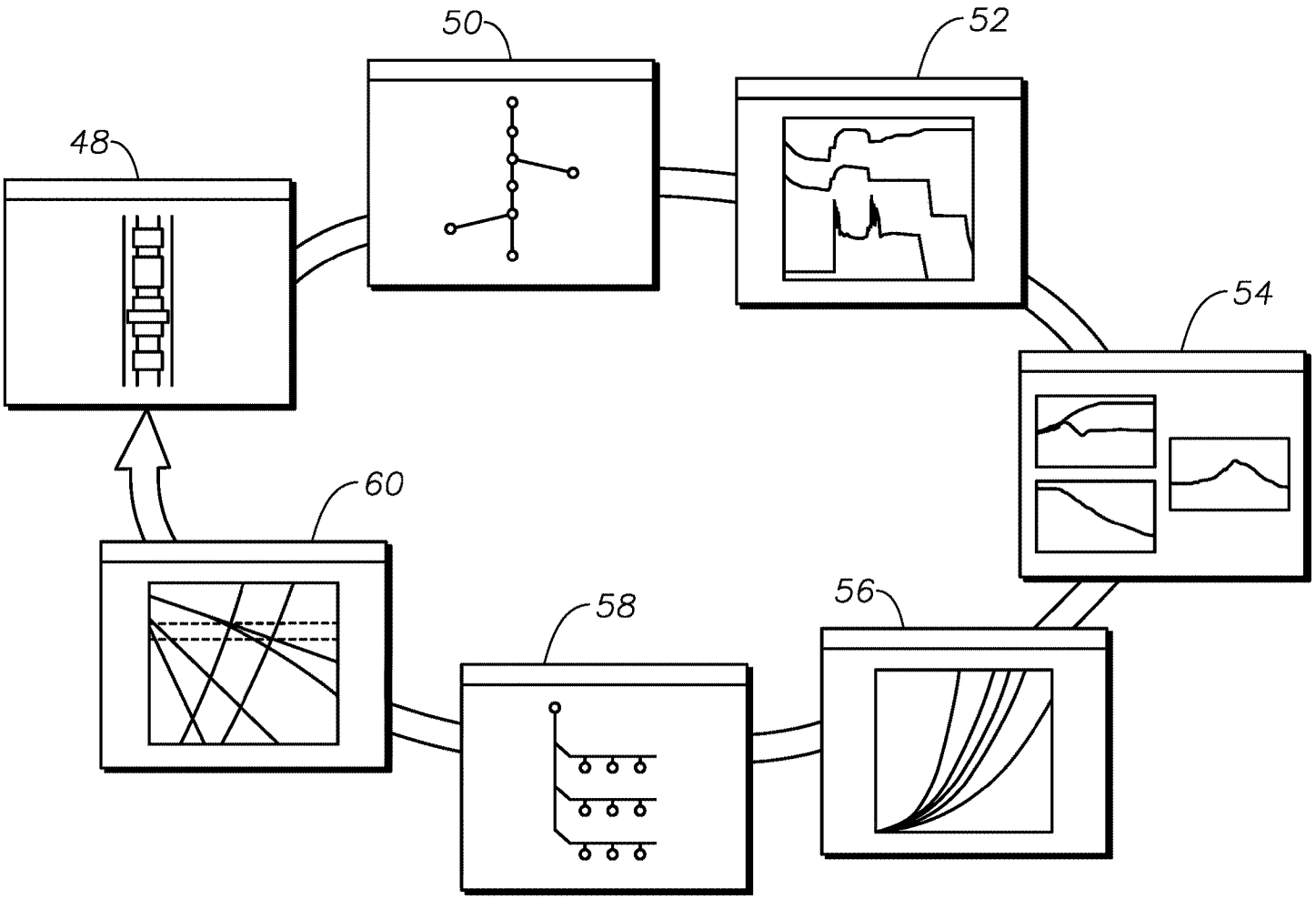
FIG. 4 is a schematic illustration representing an example of workflows in a flow control valve setting system, according to an embodiment of the disclosure.

FIG. 4 is a schematic illustration representing an example of workflows in a flow control valve setting system, according to an embodiment of the disclosure. Referring generally to FIG. 4, a graphical representation is provided to illustrate an example of the model-based architecture and workflows integration. The model-based architecture and workflows integration creates a loop which facilitates optimization of flow control valve settings during operation of a multizone well, e.g. a multilateral well having multiple zones. In this example, a completion schematic or other representation of the actual multilateral well completion 20 is obtained, as indicated by block 48. Based on the architecture of the actual multilateral well completion, a network model is created, as represented by block 50. A wide variety of data, as discussed above, may be collected via sensor system 46 and processed via the network model, as represented by block 52.

In this example, data analysis is then conducted through a deconvolution of the data, as represented by block 54. The data also is analyzed to determine gas and/or water breakthrough, as represented by block 56. An optimization process, e.g. an optimization algorithm, is then applied to the data to determine optimized scenarios for a given objective function, e.g. maximum well production, reduced water cut, gas control, or other objective function, as represented by block 58. The results may then be output, e.g. plotted, in relation to inflow-outflow curves for flow evaluation, as represented by block 60. By way of example, the flow evaluation may be an identification of cross flows between well zones. The results of the flow evaluation are used to validate or adjust the settings of the flow control valves 36, and then the process/loop may be repeated to enable continued optimization for the desired objective function or functions.

Accordingly, the example illustrated in FIG. 4 generally shows the overall workflow for achieving optimum settings of flow control valves 36 in well completion 20. The well completion details are converted into a wellbore network model, and data available from the various sensors of sensor system 46 is analyzed to obtain reservoir properties and fluid related properties. The network model is updated with the latest results received from the sensors for optimization of flow control valve area settings based on the desired, objective function. The results are then provided, e.g. plotted, in relation to inflow-outflow curves for flow evaluation, e.g. cross flow identification, and these updated settings can be implemented at the well site.

Application of the network model and processing of data may be performed on control system 44. By way of example, control system 44 may be a processor-based system, such as a computer system which receives data from the sensors and processes that data via software modules according to parameters provided by the network model.

Figure 5:
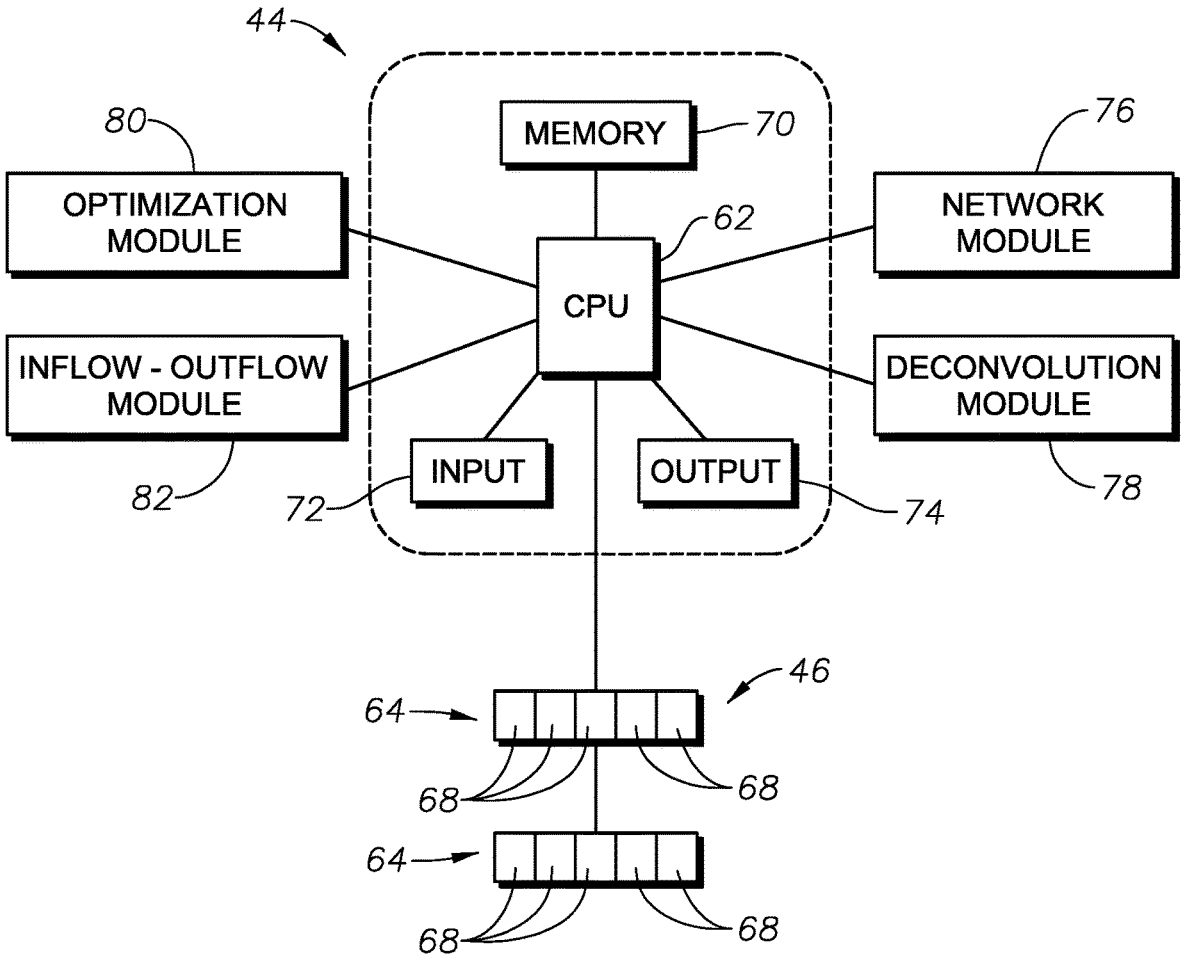
FIG. 5 is a schematic illustration of a processing system which may be used to process data obtained from sensors according to modules of a multizone well flow control valve setting system, according to an embodiment of the disclosure.

FIG. 5 is a schematic illustration of a processing system 44 which may be used to process data obtained from sensors according to modules of a multizone well flow control valve setting system, according to an embodiment of the disclosure. In FIG. 5, an example of a processor-based control system 44 is illustrated and may comprise a real time acquisition and control system such as that facilitated by the Avocet software program. In this example, the system 44 may comprise a processor 62 in the form of a central processing unit (CPU). The processor 62 is operatively employed to intake and process data obtained from the sensors 64 of sensor system 46. By way of example, sensors 64 may comprise flow control valve sensors 66 mounted on or near flow control valves 36 to monitor flow control valve settings (e.g. valve flow areas), flow rates through the flow control valves, and/or other flow control valve related parameters (e.g. pressure, temperature, and fluid phase identification parameters). The sensors 64 also may comprise a variety of other sensors 68, e.g. pressure sensors, temperature sensors, flow sensors, and/or other sensors, positioned at various locations in lateral bores 24, 26, 28 and/or other locations along multilateral well 22.

In the example illustrated in FIG. 5, the processor 62 may utilize the real time acquisition and control system, e.g. Avocet, and also may be operatively coupled with a memory 70, an input device 72, and an output device 74. Memory 70 may be used to store many types of data, such as data collected and updated via sensors 64. Input device 72 may comprise a variety of devices, such as a keyboard, mouse, voice recognition unit, touchscreen, other input devices, or combinations of such devices. Output device 74 may comprise a visual and/or audio output device, such as a computer display, monitor, or other display medium having a graphical user interface. Additionally, the processing may be done on a single device or multiple devices locally, at a remote location, or with some local devices and other devices located remotely, e.g. a server/client system.

The processor-based control system 44 is able to work with a variety of modules, e.g. software modules, for implementing the flow control valve setting methodology. For example, the real time acquisition and control system/processor 62 may be used in cooperation with a network module 76 which comprises a wellbore network model, e.g. Pipesim, representing the various components of multilateral well completion 20. Additionally, the control system 44 may comprise a deconvolution module 78; and the processor 62 may work in cooperation with the deconvolution software module to perform deconvolution of pressure transient responses to continuous zonal rate changes instigated by the actuation of flow control valves 36. The deconvolution module 78 may utilize a standard/multiwell deconvolution algorithm to process the data.

By way of further example, an optimization module 80, e.g. an optimization algorithm, may be used in cooperation with processor 62 for optimizing a given objective function based on data received from sensors 64. An inflow-outflow module 82 also may be used with processor 62 to provide a performance interpretation and advisory technique using nodal analysis of the multilateral well completion 20 and well 22. Modules 76, 78, 80, 82 are examples of various software programs which may be used on control system 44 in carrying out the flow control valve setting procedure described herein. The various raw data, analyses, updated data, modeling results, and/or other types of raw and processed data may be stored in memory 70 and evaluated via the appropriate module.

Figure 6:
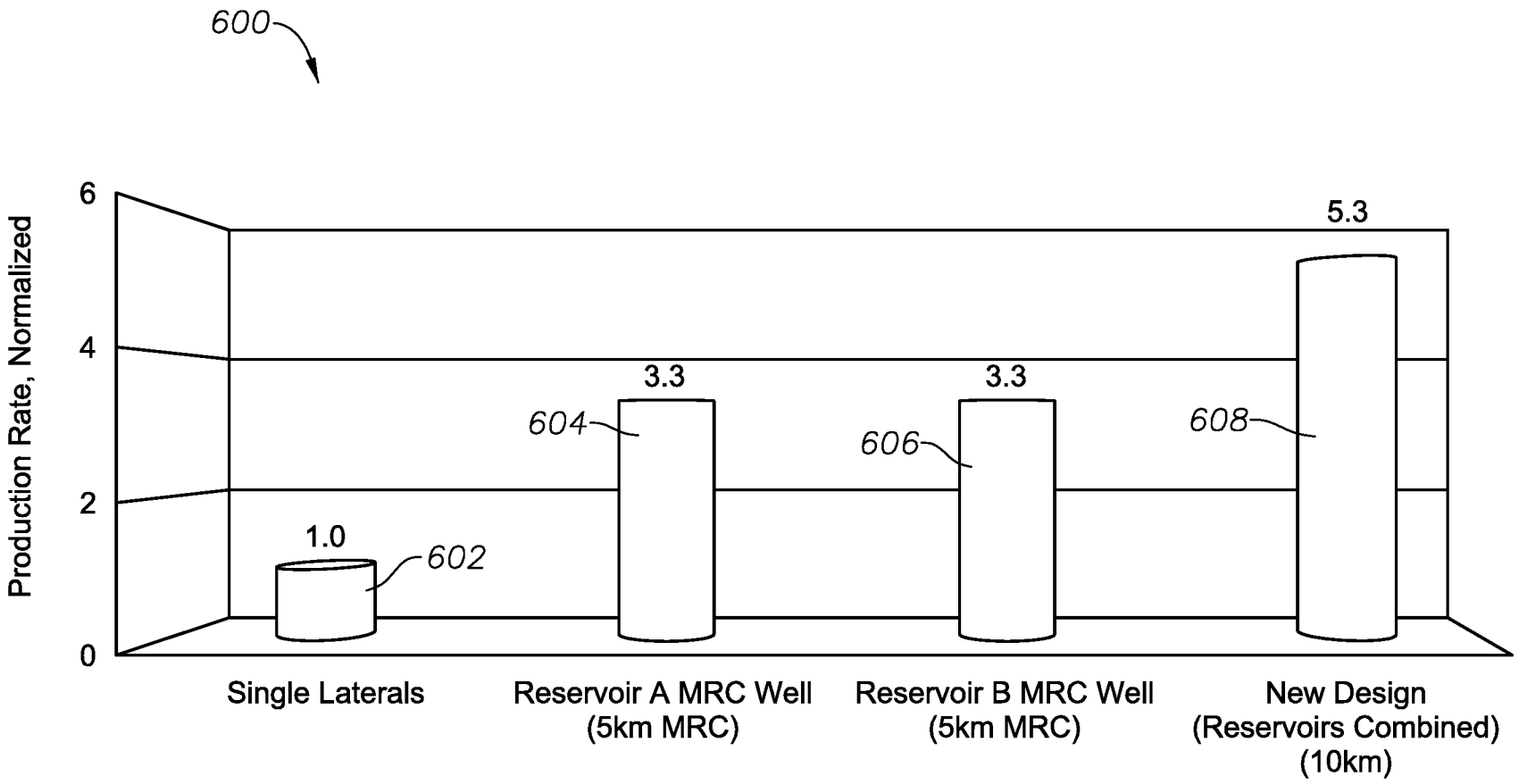
FIG. 6 is a graph comparing normalized productions rates of wells according to prior art with an aggregate MRC well, according to one or more example embodiments of the disclosure.

FIG. 6 is a graph 600 comparing normalized productions rates of wells according to prior art 602, 604, 606 with the normalized production rate of an aggregate MRC well 608 according to one or more example embodiments of the disclosure. FIG. 6 shows the performance of the well 100 after it was put on production by achieving the target rate through one well beside cost saving for the aforementioned advantages.

Maximum Reservoir Contact (MRC) wells provide a solution for the high demand for crude oil through use of tight reservoirs. Combining multiple MRC wells in one well supplemented by compartmental control offers cost saving in addition to overcoming the impracticality to drill multiple MRC wells in the same vicinity. The disclosure herein generally involves a methodology and system for setting flow control valves to improve performance. For example, the methodology and system may be used in a multizone well with zonal isolation to optimize a desired objective function, such as improving the flow of oil from the multizone well. A network of flow control valves is provided in a completion network disposed along isolated well zones of a lateral bore or lateral bores of the multizone well. Data is acquired from downhole sensors and processed on processor system modules. Examples of such modules comprise completion network modules, deconvolution modules, optimization modules, and/or inflow-outflow modules which may be used collectively or in various combinations. The modules may be software modules designed to process the collected data in a manner which facilitates adjustment of the flow control valve settings in the network of flow control valves to improve the desired objective function. The modules may be designed to process the collected data in a manner which facilitates adjustment of the optimum flow control valve settings in the network of flow control valves. By way of example, the flow control valve settings are adjusted to improve a desired objective function, e.g. maximization of oil and/or minimization of water and gas production, of the multizone well while applying constraints at the multilateral/multizone level, e.g. constraints regarding draw down, bubble point, flow balance, and flow rate restriction.

By way of example, the system and methodology may be used for setting the flow areas of flow control valves to achieve optimal zonal allocation of the production rate on the basis of downhole sensor data. The system and methodology enable improved feedback and optimization of the desired objective function as compared to previous modelless data driven techniques which relied on trending of gauge data to provide a short response time feedback to the flow control valves as part of a production monitoring setup. Embodiments of the present disclosure include the use of analytical well modeling tools and integrated workflows which can be used "on-the-fly" and in real time to manipulate and optimize flow control valve settings.

In an embodiment of a methodology for optimizing flow control valve settings, the methodology comprises deconvolution of the pressure transient response to continuous zonal flow rate changes instigated by flow control valve actuation. The methodology also may comprise inflow-outflow performance interpretation and an advisory technique using nodal analysis of the wellbore and well completion that is calibrated by the deconvolution results. Additionally, the methodology may comprise an optimization technique which sets flow control valve positions within specified constraints to optimize, e.g. maximize, a given objective function. The methodology may further be used to identify gas and/or water breakthrough by applying sensor data, e.g. pressure-volume-temperature (PVT) data, to flow control valve choke curves. Deconvolution is a methodology used for reservoir evaluation through pressure transient testing, and inflow-outflow performance optimization has been employed for single zone completions. However the present application provides a simple graphical interface depicting interdependence of zonal flow rates and flowing pressures when flow through more than one flow control valve or more than one well zone is commingled into the same wellbore flow path. Additionally, the current methodology facilitates identification of gas and/or water breakthrough by utilizing choke curves generated (Delta P versus Q) using a mechanistic choke model for a certain fluid PVT and varying gas-oil-ratios (GOR)/water cuts. The (Delta P versus Q) data obtained from the flow control valves in real-time may be overlaid on a set of type curves to identify gas and/or water breakthrough quantitatively.

In some embodiments, the flow control valve settings are controlled via a methodology derived from a model-based architecture and workflows. This approach utilizes wellbore, reservoir, and fluid parameters including, for example, depths, completion tubing inside diameters, completion equipment installed, reservoir properties, pressure-volume-temperature data, and/or other parameters.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "operatively connecting" and its conjugated forms means to complete any type of required junction, including electrical, mechanical or fluid, to form a connection between two or more previously non-joined objects. If a first component is operatively connected to a second component, the connection can occur either directly or through a common connector. "Optionally" and its various forms means that the subsequently described event or circumstance may or may not occur. The description includes instances where the event or circumstance occurs and instances where it does not occur.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The systems and methods described herein, therefore, are well adapted to carry out the objects and attain the ends and advantages mentioned, as well as others inherent therein. While example embodiments of the system and method have been given for purposes of disclosure, numerous changes exist in the details of procedures for accomplishing the desired results. These and other similar modifications may readily suggest themselves to those skilled in the art, and are intended to be encompassed within the spirit of the system and method disclosed herein and the scope of the appended claims.

The invention claimed is:

1. An aggregate maximum reservoir contact (MRC) well for extracting hydrocarbons from multiple subsurface formations, the aggregate MRC well comprising:

a plurality of maximum reservoir contact (MRC) wells, certain of the plurality of the MRC wells extending through a first reservoir, and other of the plurality of the MRC wells extending through a second reservoir, where the first reservoir and the second reservoir are stacked reservoirs that are separated;

a plurality of independently operated flow completion units installed in each of the plurality of MRC wells, each of the plurality of independently operated flow completion units having a pressure sensor, chemical tracer, flow rate sensor, and flow control value within a single unit body;

a plurality of pressure regimes corresponding to the plurality of MRC wells; and a single production string connecting each of the plurality of pressure regimes in each of the plurality of MRC wells.

2. The aggregate MRC well according to claim 1, further comprising:

means for determining productivity index of each of the plurality of MRC wells.

3. The aggregate MRC well according to claim 1, further comprising:

means for determining flow rate or production rate of each of the MRC wells.

4. The aggregate MRC well according to claim 1, wherein the aggregate MRC well has contact of about 10 kilometers (6.21 miles) or more.

5. The aggregate MRC well according to claim 1, wherein the aggregate MRC well comprises a multilateral configuration comprising two or more laterals, each lateral well comprising a plurality of MRC wells.

6. A method for extracting hydrocarbons from a subsurface formation, the method comprising:

providing a plurality of maximum reservoir contact (MRC) wells forming an aggregate MRC well, extending certain of the plurality of the (MRC) wells through a first reservoir, and extending other of the plurality of the MRC wells through a second reservoir, where the first reservoir and the second reservoir are stacked reservoirs that are separated;

providing a plurality of independently operated flow completion units in each of the plurality of MRC wells, each of the plurality of independently operated flow completion units having a pressure sensor, chemical tracer, flow rate sensor, and flow control valve within a single unit body;

providing a plurality of pressure regimes corresponding to the plurality of MRC wells; and providing a single production string connecting the plurality of pressure regimes in each of the plurality of MRC wells.

7. The method according to claim 6, further comprising:

providing a means for determining productivity index of each of the plurality of MRC wells.

8. The method according to claim 6, further comprising:

providing a means for determining flow rate or production rate of each of the MRC wells.

9. The method according to claim 6, wherein the aggregate MRC well has a contact of about 10 kilometers (6.21 miles) or more.

10. The method according to claim 6, wherein the aggregate MRC well comprises a multilateral configuration comprising two or more lateral wells, each lateral well comprising a plurality of MRC wells.

* * * * *